United States Patent [19]

D'Antonio et al.

[11] 4,402,524

[45] Sep. 6, 1983

[54] BATTERY-CHARGING GENERATOR FOR ELECTRONIC SKI BINDING

[75] Inventors: Nicholas F. D'Antonio, Liverpool, N.Y.; Dieter Polt, Murnau; Volker Eibl, Garmisch-Part., both of Fed. Rep. of Germany

[73] Assignee: Marker-Patentverwertungsgesellschaft mbH, Baar, Switzerland

[21] Appl. No.: 220,047

[22] PCT Filed: May 30, 1980

[86] PCT No.: PCT/EP80/00034

§ 371 Date: Dec. 12, 1980

§ 102(e) Date: Dec. 12, 1980

[87] PCT Pub. No.: WO80/02648

PCT Pub. Date: Dec. 11, 1980

[30] Foreign Application Priority Data

Jun. 7, 1979 [DE] Fed. Rep. of Germany ..... 2923173
Oct. 8, 1979 [DE] Fed. Rep. of Germany ..... 2940784

[51] Int. Cl.[3] ..... A63C 9/08
[52] U.S. Cl. ..... 280/612; 320/61
[58] Field of Search ..... 280/612, 816, 611; 320/61; 310/339; 180/65 D

[56] References Cited

U.S. PATENT DOCUMENTS 3,534,391 10/1970 Bauer ..... 280/816 X
3,762,735 10/1973 Smolka ..... 280/612
3,808,418 4/1974 Conard et al. ..... 310/339 X
3,819,199 6/1974 Smolka et al. ..... 280/612
3,819,963 6/1974 Kondo et al. ..... 310/339
4,114,305 9/1978 Wohlert et al. ..... 310/25 X
4,239,974 12/1980 Swander et al. ..... 320/61 X

FOREIGN PATENT DOCUMENTS 2400626 7/1975 Fed. Rep. of Germany .
2519544 11/1975 Fed. Rep. of Germany ..... 280/612
2821262 11/1979 Fed. Rep. of Germany .
2838860 3/1980 Fed. Rep. of Germany .
2919566 11/1980 Fed. Rep. of Germany ..... 280/612
2418655 3/1978 France .
7710239 9/1977 Sweden ..... 320/61

*Primary Examiner*—Joseph F. Peters, Jr.
*Assistant Examiner*—Michael Mar
*Attorney, Agent, or Firm*—Squire, Sanders & Dempsey

[57] ABSTRACT

A safety ski binding comprises force-pick-ups for generating electric signals in response to forces and/or torques acting on the skier's leg, an electronic integrated circuit for initiating the operation of the releasing mechanism by a tripping signal generated in response to the occurence of dangerous forces or torques, and a rechargeable battery for feeding the circuit. In order to avoid a continuous maintenance of the battery (B) it is supplied with charging current from a generator (8, 10; 21, 22). The generator comprises parts that are movable relative to each other for a generation of electric power and are respectively connected to a member (1) of the ski binding and to the surface of the ski (5).

11 Claims, 10 Drawing Figures

BATTERY-CHARGING GENERATOR FOR ELECTRONIC SKI BINDING

Figure 1:
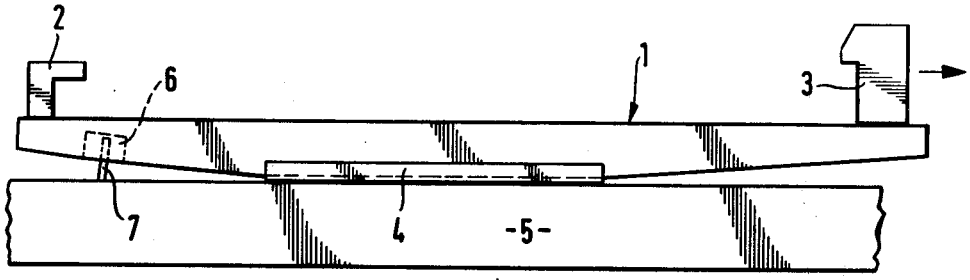

This invention relates to a safety ski binding comprising force pick-ups for generating electric signals in response to forces and/or torques acting on the skier's leg, an electronic integrated circuit for initiating the operation of the releasing mechanism by a tripping signal generated in response to the occurrence of dangerous forces or torques, and a rechargeable battery for feeding the circuit.

Electronic safety ski bindings having a battery-fed circuit are known, e.g. from Opened German Specifications 2,444,949 and 2,519,544. A reliable function of an electronic ski binding system cannot be ensured unless the battery which feeds the electronic circuit has a sufficiently high charge. As a replacement of the battery in regular intervals of time is inconvenient for the skier, the use of rechargeable batteries is desirable. Such batteries can be charged by being connected to any desired source of current. It is known from Opened German Specification 2,519,544 to use solar cell chargers for charging the batteries.

For this reason it is an object of the invention to provide a safety ski binding which is of the kind described first hereinbefore and which requires substantially no maintenance because it is combined with charging means for maintaining the battery in an adequately charged state.

This object is accomplished according to the invention in that the battery is supplied with charging current from a generator, which comprises parts that are movable relative to each other for a generation of electric power and are respectively connected to a member of the ski binding and to the surface of the ski. In the safety ski binding according to the invention, the relative movements effected during skiing between the ski and binding members secured to the ski are utilized for a generation of the electric current which is used to charge the battery. As a result, the skier need no longer pay attention to the charged state of the battery of his electronic safety ski binding so that the latter is almost maintenance-free. As it is ensured in the safety ski binding according to the invention that the battery for feeding the electronic circuit is in an adequately charged state, additional safety risks involved in the battery will be avoided. Relative movements between the ski and the binding members are continually effected during skiing so that there is always adequate kinetic energy for the generation of the charging current. In the known solar cell charger this is not ensured when the solar cells are covered by dirt or snow.

In a preferred embodiment of the invention, the movable parts consist of a piezoelectric transducer composed of either a singular element or a plurality of piezoelectric wafers, and a member for applying pressure to said transducer. In this embodiment, the considerable pressures which are applied during skiing and which change the distance between the ski and members of the ski binding, are converted by means of the piezoelectric transducer into electric voltages. As the piezoelectric wafer(s) generate high voltages and only small currents in response to an application of pressure, a transformer must be provided to increase the current while reducing the voltage. A rectifier is provided for rectifying the current that has been produced by the piezoelectric generator.

It is known from Opened German Specification 2,244,949 to use piezoelectric elements as force pick-ups.

The piezoelectric transducer may consist of a single or plurality of layers of zirconate-titanate ceramic material (PZT ceramic material). The transducer is suitably secured to the undesirable of a ski binding member which protrudes from the mounting plate of the ski binding, and the pin for applying pressure to said binding member bears or is secured to the surface of the ski.

According to another embodiment of the invention, the relatively movable parts of the generator consist of an induction coil and a permanent magnet which extends through or into the moving coil. In that case, the charging current is generated electrodynamically in that, e.g. the air gap between the magnetic pole of a closed magnetic circuit is changed by the forces which are continually exerted in the ski binding system during skiing so that an electromotive force is induced in an induction coil which is linked by the lines of magnetic flux. After rectification, that electromotive force is used to charge an electric storage battery. The induction coil may consist of a moving coil that is secured to a ski binding member which protrudes beyond the mounting plate of the ski binding, whereas the permanent magnet or the element which carries the permanent magnet bears on or is secured to the surface of the ski.

Because the electrodynamic generation of charging current depends on the velocity at which the induction coil intersects the lines of flux of the permanent magnet, the excursion of the permanent magnet or of the coil and the relative velocity between these two parts of the generator can be increased in that the kinetic energy derived from the ski and the binding is transmitted by an interposed mechanism. For instance, the permanent magnet may be secured to an arm, which is pivoted on an axis that is at right angles to the surface of the ski, the permanent magnet may extend into a coil that is parallel to the surface of the ski, and the arm may be driven by means for transforming the relative motion between the ski and the ski binding members into a reciprocating motion.

According to a further feature of the invention, the generator for charging the battery is totally enclosed in the ski binding plate and the kinetic energy is transmitted to the movable part of the generator by an elastic diaphragm which forms part of the wall of the ski binding plate.

The batteries may consist, e.g., of Mallory batteries. The charging generators used operate satisfactorily at temperatures which may be as low as or lower than −20° C. Piezoelectric transducers are operative at temperatures in a range from −75° C. to +200° C.

The object set forth can also be accomplished in accordance with the invention by the further proposal to supply the battery with charging current from a generator which consists of a permanent magnet which is oscillated in a coil secured to the ski or the ski binding and which is carried by at least one spring connected to the means for fixing the coil. The permanent magnet and the spring carrying it constitute an oscillatory system in which the magnet oscillates at a relatively high frequency in the induction coil. The magnet may be gripped between two springs. The oscillations are excited by the jerks which are effected during skiing.

A further inventive development provides a simple generator arrangement which has a particularly high efficiency. This is accomplished in that the relatively movable parts are mounted on the soleplate of the ski binding at the heel holder, that the heel holder has a step-in function and that one generator part is mounted on the movable soleholder and the other on the stationary part of the binding. Because the generator parts incorporated in the heel-holding section of a step-in binding perform a large displacement as the skiing boot is stepped into said section, this movement can be utilized to make a large amount of energy available.

According to a further feature of the invention, the electric power which during the stepping into the heel holder is generated in the generator associated therewith is supplied to a capacitor for feeding a solenoid for releasing the binding whereas the electronic logic circuitry is fed only by the battery. This results in a very low consumption of battery powder.

It will be understood that the electric power which is generated by the stepping into the binding may be used to charge the battery and the capacitor.

In accordance with a further feature of the invention, an electronic monitor circuit may be provided which connects the built-in battery in circuit with the capacitor when the voltage across the latter decreases below a predetermined threshold value.

Figure 2:
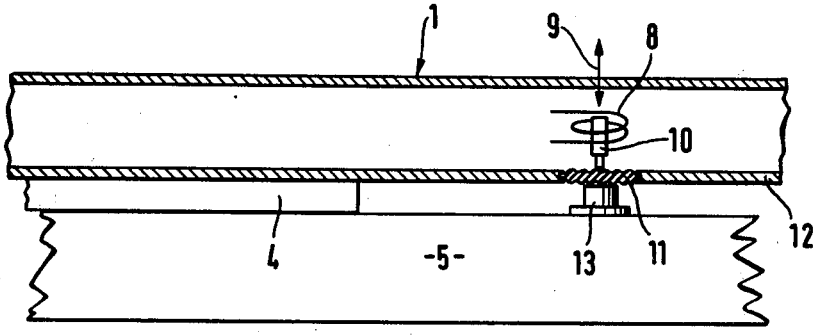
Figure 3:
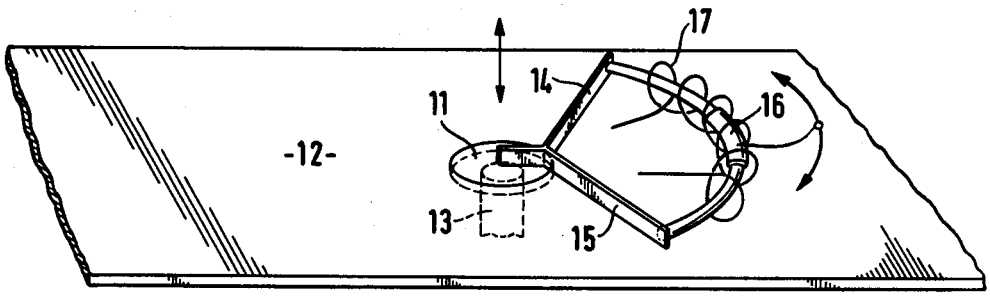
Figure 4:
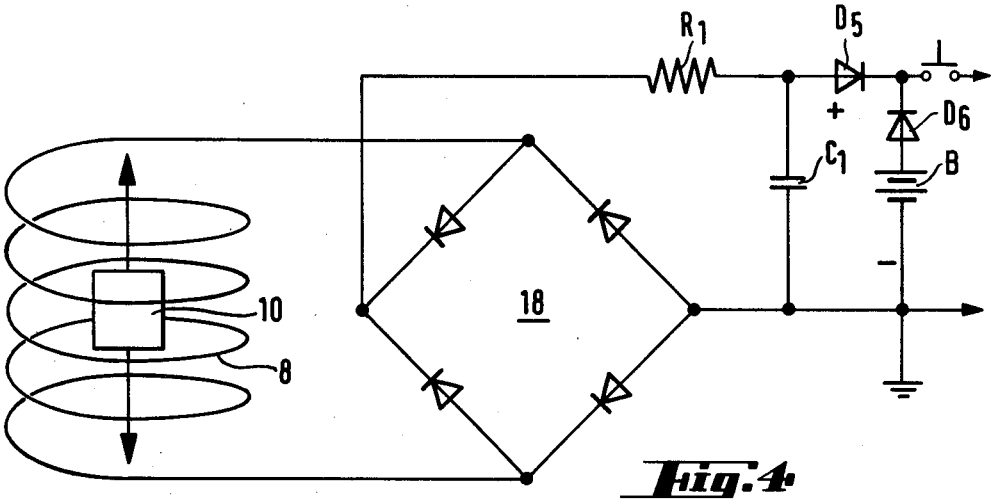
Figure 5:
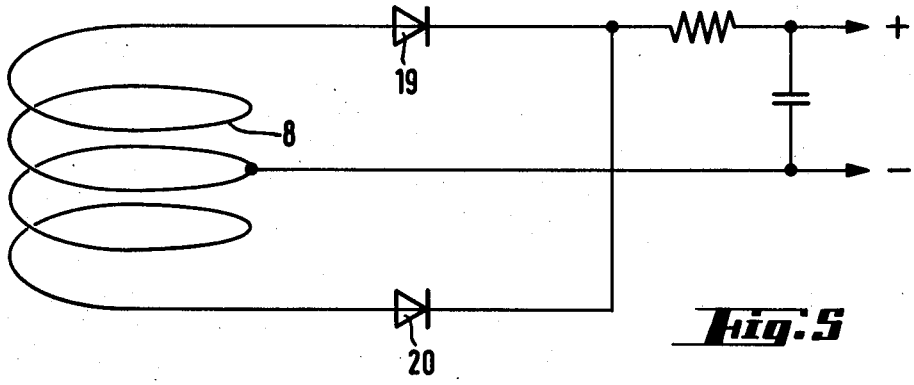
Figure 6:
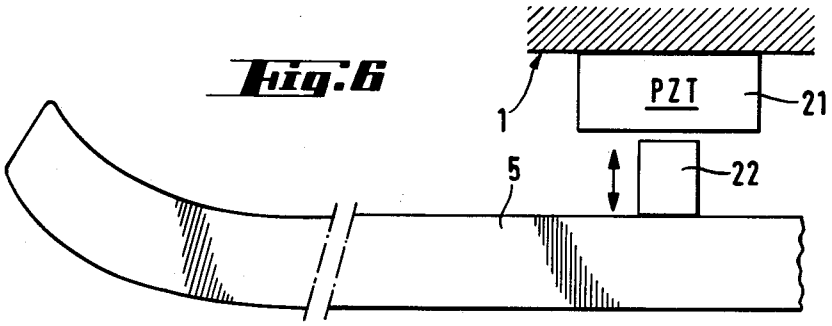
Figure 7:
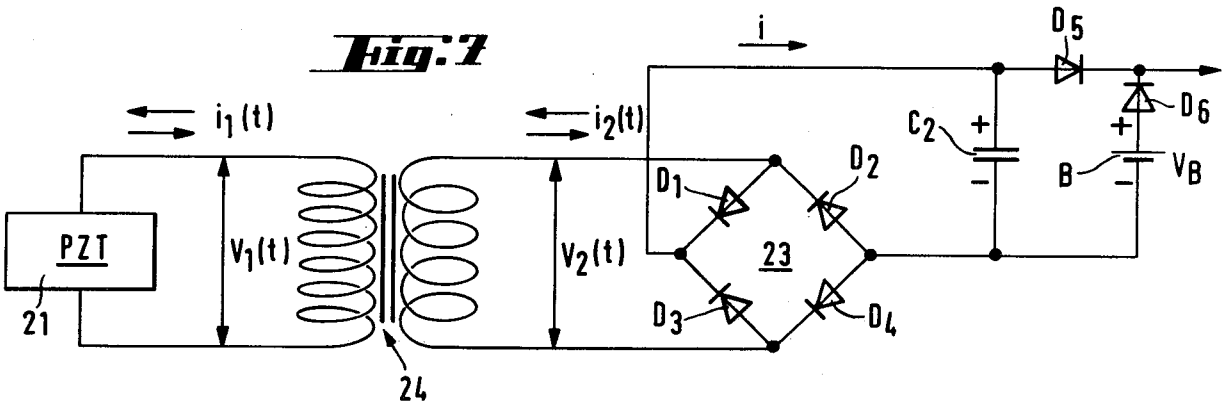
Figure 8:
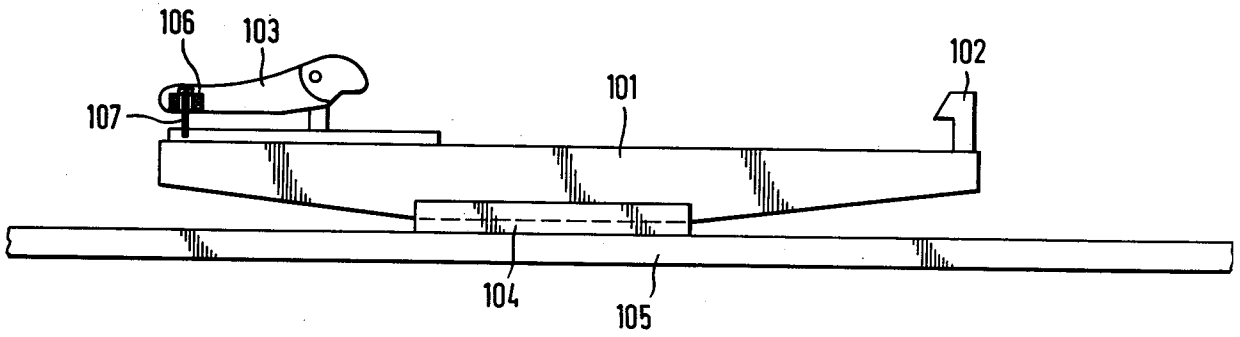
Figure 9:
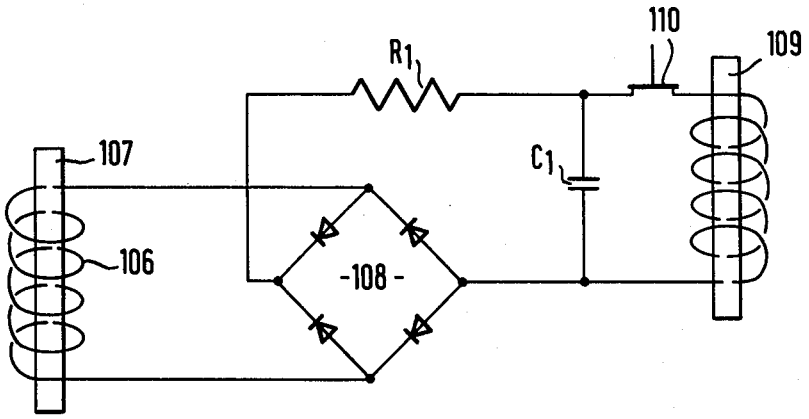
Figure 10:
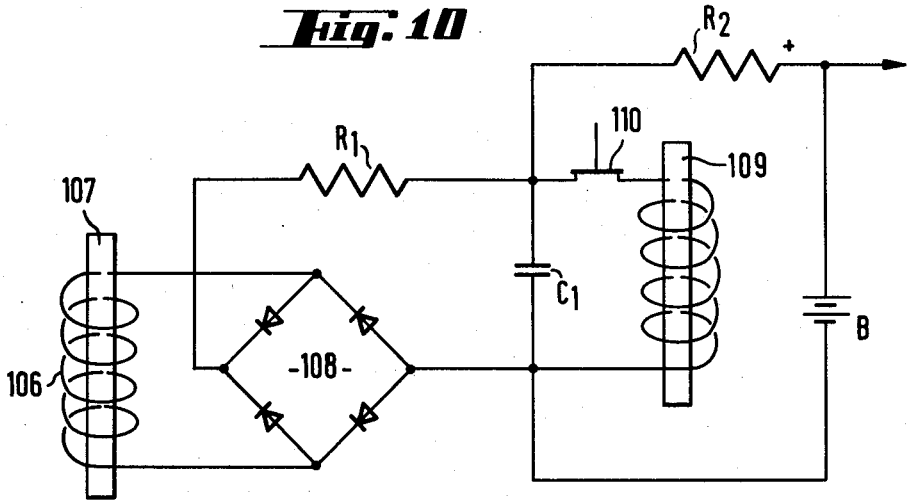

Embodiments of the invention will be explained more fully hereinafter by way of example with reference to the accompanying drawings, in which FIG. 1 is a side elevation showing an electronic safety ski binding that is secured to a ski and provided with a generator for generating battery-charging current, FIG. 2 is a longitudinal sectional view showing a soleplate of an electronic ski binding, which soleplate is secured to a ski and in which the electronic circuit and the generator for generating the charging current are totally enclosed, FIG. 3 is a diagrammatic view showing a permanent magnet which oscillates in an induction coil parallel to the surface of the ski, FIG. 4 is a circuit diagram of the charging circuit, FIG. 5 is a circuit diagram of another embodiment of the charging circuit, FIG. 6 is a diagrammatic representation of the arrangement of the piezoelectric transducer and of a member for applying pressure to said transducer between the surface of the ski and the ski binding, FIG. 7 is a circuit diagram showing the charging circuit including a piezoelectric transducer, FIG. 8 is a side elevation showing an electronic safety ski binding which is secured to the ski and comprises a generator that is arranged in the heel-holding section and serves to generate battery-charging current, FIG. 9 is circuit diagram of a circuit for charging the capacitor, and FIG. 10 is a circuit diagram of a circuit for charging the capacitor and the battery.

The general arrangement of the electronic safety ski binding is apparent from FIG. 1. The electronic safety ski binding comprises a soleplate 1, in which the electronic circuits and components are totally enclosed. The soleplate 1 carries at its forward end a soleholder 2, which engages the sole of the skiing boot from above at the forward end of the skiing boot. A soleholder 3 for engaging the heel from above is provided at the rear end of the soleplate 1 and in case of a safety release yields rearwardly to release the heel of the skiing boot so that the entire skiing boot is released. The mechanism for moving the soleholder 3 is accommodated in the soleplate 1 and triggered by an electric signal. The soleplate 1 is secured to the ski 5 in known manner by a mounting plate 4.

The charging current generator is also accommodated in the soleplate 1 and consists of an element 6 that is accommodated in the plate 1 and an element 7 which is movable relative to the element 6 and secured to or bears on the ski 5. The elements 6, 7 may consist of an induction coil and a permanent magnet or of a piezoelectric transducer and a member for applying pressure thereto.

The relative motion between the ski 5 and that portion of the soleplate 1 which protrudes beyond the mounting plate 4 are utilized to generate the charging current.

In the embodiment shown in FIG. 2, an induction coil 8 is disposed within the soleplate 1 and a permanent magnet 10 moves in the coil 8 in the direction of the double-headed arrow 9. The permanent magnet bears at its lower end on a flexible diaphragm 11, which closes an opening in the bottom wall 12 of the soleplate 1. A pin 13 is secured to the ski 5 and at its top end engages the outside surface of the diaphragm 11. Any relative motion between the ski 5 and the diaphragm 11 during skiing will be transmitted by the pin 13 and the diaphragm 11 to the magnet 10 so that the latter oscillates and currents are induced in the coil 8.

In the embodiment shown in FIG. 3, the diaphragm 11 is moved by the pin 13 and a mechanism, not shown, is used to transmit the motion of the diaphragm 11 to the arms 14, 15, between which the permanent magnet 16 is gripped and which are thus caused to oscillate parallel to the surface of the ski. As the permanent magnet 16 oscillates in the induction coil 17, currents are generated in the latter.

The charging circuits including the charging current generators of FIGS. 2 and 3 are diagrammatically shown in FIGS. 4 and 5. The alternating current generated in the induction coil 8 is rectified by the bridge rectifier 18 and is supplied to the battery B via the resistor or choke R1 and the capacitor C1.

Diode D6 is only included for the case where the system battery cannot be recharged. If capacitor C1 or C2 has a lower voltage than battery B, only then will battery B provide the system with power. Other means can be used to prevent battery B from receiving a charging voltage.

In the circuit shown in FIG. 5, the induction coil 8 has a center tap and the ends of the induction coil 8 are connected by rectifying diodes 19, 20 to the positive output terminal.

If the charging current generator consists of a piezoelectric transducer 21 composed of a plurality of layers or wafers of piezoelectric ceramic material, as shown in FIG. 6, pressure will be applied to the generator by a pin 22, which is secured to the ski. The piezoelectric transducer 21 may be accommodated in the soleplate 1 and may be connected to the pin 22 by the diaphragm 11 which encloses the soleplate.

The charging circuit including a piezoelectric transducer is apparent from FIG. 7. The power generated by the piezoelectric transducer at a high voltage is transformed by the transformer 24 to power at a lower voltage and a higher current. The transformed voltage is rectified by the bridge rectifier consisting of the diodes D1 to D4 and is supplied to the battery B through diode D5 via the capacitor C2. Diode D5 prevents the battery from supplying current back to the capacitor C2 if the generated voltage is lower than the battery voltage.

Another general arrangement of the electronic safety ski binding is apparent from FIG. 8. The electronic safety ski binding comprises a soleplate 101, in which the electronic circuits and components are totally enclosed. The soleplate 101 is connected to the ski 105 by the mounting plate 104. The soleplate 101 carries at its forward end a soleholder 102, which engages the sole of the skiing boot from above at the forward end of the skiing boot. A heel holder 103 for engaging the heel of the skiing boot from above is associated with the rear end of the soleplate 101 and has preferably a step-in function. A generator 106, 107 is associated with the heel holder 103 in such a manner that the induction coil 106 is accommodated in and protected by a lever, which is moved as the skiing boot steps into and out of the ski binding, whereas the permanent magnet 107 is mounted on the stationary part of the binding. That arrangement may obviously be kinematically inverted.

In accordance with FIG. 9 the alternating current induced in the induction coil 106 is rectified by the bridge rectifier 108 and then supplied through the resistor R1 to the capacitor C1 to recharge the latter. The electric power from the capacitor is used only to feed the solenoid 109 which moves the mechanical part of the binding whereas the electronic logic circuitry is fed only by the battery.

In accordance with FIG. 10 the alternating current generated in the induction coil 106 is also rectified by the bridge rectifier 108 and then supplied via the resistor R1 as a charging current to the capacitor C1, which feeds the solenoid 109, and to the battery B for supplying the electronic logic circuitry. As a result, both energy storage devices are recharged as required by the generator 106, 107 provided in the heel-holding section 103.

To prevent capacitor C1 from instantly discharging into the coil 109 a switch 110 is provided. The switch 110, preferably a transistor of some type, will be closed when a release command is given and C1 will discharge through the solenoid coil which will then open the binding.

What is claimed is:

1. An electronic ski binding having an electrical generator for charging a power source, which binding includes a movable binding member mountable on a ski and being movable relative to the ski, said generator comprising induction coil means and magnet means movable relative to each other for generating a current for charging the power source, one of said coil means and of said magnet means being fixedly mounted on said movable binding member and the other of said coil means and of said magnet means being mountable to move with respect to the one of said coil means and said magnet means during operation of the ski binding, whereby said coil means and said magnet means are movable relative to each other during skiing and/or during the stepping of a skier into the binding to charge the power source.

2. The invention of claim 1, said generator further including a flexible diaphragm for transmitting kinetic energy to said coil means and said magnet means.

3. The invention of claim 1, wherein said ski binding includes a movable ski boot latch and having step-in means comprising the other of said coil means and said magnet means mounted on said ski boot latch.

4. An electronic ski binding having an electrical generator for charging a power source, which binding includes a movable binding member mountable on a ski and being movable relative to the ski, said generator comprising rod means and current producing means movable relative to each other for generating a current to charge the power source, one of said rod means and of said current producing means being fixedly mounted on said movable binding member and the other of said rod means and of said current producing means being mountable to move with respect to the one of the rod means and of said magnet means during operation of the ski binding, whereby said rod means and said current producing means are movable relative to each other during skiing and/or during the stepping of a skier into the binding to charge the power source.

5. The invention of claim 4 wherein said piezoelectric transducer comprises a zirconate-titanate ceramic material.

6. The invention according to claim 4 wherein said current producing means comprises a piezoelectric transducer, and said rod means comprises a member for applying pressure to said transducer during operation of said ski binding.

7. The invention according to claim 4 wherein said current producing means comprises an induction coil and said rod means comprises a magnet extendable into said coil.

8. The invention according to claim 4 wherein said rod means is mountable in fixed relation to a ski on which the binding is mountable, and said current producing means is fixedly mountable on said movable binding member.

9. The invention of claim 4, wherein said generator further includes a flexible diaphragm for transmitting kinetic energy to said rod means and said current producing means.

10. The invention of claim 4 herein said ski binding includes a movable ski boot latch having step-in means comprising the other of said rod means and of said current producing means.

11. The invention of claims 1 or 4 wherein said safety ski binding includes a capacitor and a release solenoid for activating release of said binding, said capacitor storing and supplying electrical energy to said solenoid, and wherein said step-in charging current charges said capacitor.

* * * * *